US007700535B1

(12) United States Patent
Ward

(10) Patent No.: US 7,700,535 B1
(45) Date of Patent: Apr. 20, 2010

(54) WAFER/INGOT CLEANING IN WIRE SAW CUTTING COMPRISING AN ETHOXYLATED ALCOHOL/POLYALKYLSILOXANE MIXTURE

(75) Inventor: Irl E. Ward, Bethlehem, PA (US)

(73) Assignee: PPT Research, Allentown, PA (US)

( * ) Notice: Subject to any disclaimer, the term of this patent is extended or adjusted under 35 U.S.C. 154(b) by 0 days.

(21) Appl. No.: 12/319,735

(22) Filed: Jan. 12, 2009

(51) Int. Cl.
*C11D 1/72* (2006.01)
*C11D 9/36* (2006.01)

(52) U.S. Cl. ..... 510/175; 510/417; 510/421; 510/466; 134/2; 134/22.19

(58) Field of Classification Search ..... 510/175, 510/421, 417, 466; 134/2, 22.19
See application file for complete search history.

(56) References Cited

U.S. PATENT DOCUMENTS 5,817,711 A * 10/1998 Kambe et al. ..... 524/501
5,922,137 A * 7/1999 Fukunaga et al. ..... 134/2
6,383,991 B1 * 5/2002 Hashimoto et al. ..... 508/161
6,417,147 B2 * 7/2002 Amemiya et al. ..... 510/175
6,468,951 B1 * 10/2002 Grieger et al. ..... 510/175
6,673,754 B1 * 1/2004 Nabeshima et al. ..... 508/507
2002/0077259 A1 * 6/2002 Skee ..... 510/175
2003/0073601 A1 * 4/2003 Small et al. ..... 510/391
2003/0100455 A1 * 5/2003 Oishi et al. ..... 508/142
2004/0161933 A1 * 8/2004 Takashima et al. ..... 438/689
2005/0159322 A1 * 7/2005 Min et al. ..... 510/175
2007/0010411 A1 * 1/2007 Amemiya et al. ..... 510/175
2007/0034229 A1 * 2/2007 Okuuchi et al. ..... 134/2
2007/0277847 A1 * 12/2007 Liu et al. ..... 134/2
2008/0196742 A1 * 8/2008 Beck ..... 134/1.3
2008/0295860 A1 * 12/2008 Burger ..... 134/1
2009/0004607 A1 * 1/2009 Shimoaoki et al. ..... 430/325
2009/0093107 A1 * 4/2009 Lee et al. ..... 438/584
2009/0107520 A1 * 4/2009 Lee et al. ..... 134/2

* cited by examiner

*Primary Examiner*—Charles I Boyer
(74) *Attorney, Agent, or Firm*—John Lezdey & Assoc

(57) ABSTRACT

There is provided a method and composition for rinsing sliced ingots into wafers from a wire saw cutting operation. The method uses an alkoxylated alcohol diluted in water alone or with a polyalkyl siloxane when the bath has a dynamic flow of water to prevent foaming.

11 Claims, No Drawings

WAFER/INGOT CLEANING IN WIRE SAW CUTTING COMPRISING AN ETHOXYLATED ALCOHOL/POLYALKYLSILOXANE MIXTURE

FIELD OF THE INVENTION

The present invention relates to a composition and method for cleaning wafers and ingots used in a wire saw cutting operation. More particularly, there is provided an aqueous composition containing an alkoxylated alcohol alone or in combination with a polyalkyl siloxane for rinsing the cut wafers and ingot on a mounting beam used in the wire saw cutting operation in an aqueous bath.

BACKGROUND OF THE INVENTION

In the slicing of hard material ingots using abrasive slurries in wire saws, the cut disks/wafers coming out of the saw are surface saturated with glycol, or other water miscible or water compatible slurry from the abrasive cut. In most cases, the spaces between cut wafers are extremely small, measuring as low as ~100 μm between surfaces, or lower. In order to further process and use the cut wafers/disks for any end purpose, the entire surface of the cut wafers must be rinsed clean of all residual abrasive slurry. Any remaining residue of slurry solids may negatively impact further processing of the cut wafers/disks, reducing final use efficiency and overall production yield of the slicing process.

It is generally believed that to increase water penetration, wetting along a solid surface or spreading of water, that surface tension of water needs to be greatly lowered below its ambient STP level of about 70 Dynes/cm. In general, such a procedure can be accomplished by the addition to the water of any one of many known surface active agents or detergents.

However, effective water rinsing of slurry from microscopic spaces must also be performed without foaming. Foaming presents a direct obstacle to liquid wetting and penetration into small or large spaces by the presence of gas entrapped membranes which block or inhibit liquid water from effective contact with said spaces, holes, cavities, etc.

Further, the suspension characteristics of all current abrasive slurries including those compatible, miscible or soluble in water, are known in the art to be quickly and significantly compromised upon the exposure to excess water. The result of this solids suspension effect is the abrasive solids within the slurry, upon exposure to "rinsing volumes" of water will agglomerate, then coagulate and quickly precipitate out onto the wafer or disk surface during the rinsing process. Once such solids precipitation has occurred, continuing rinsing with water will not effectively remove the precipitated solids, and the resulting "rinsed" wafers will be contaminated with precipitated slurry solids which can be impacted on the wafer surface making further processing difficult or impractical.

To avoid the above precipitation process during the rinse step, the water rinse must be both complete and mechanically faster than the solids precipitation process on exposure to excess rinse water from the slurry coating the wafers. To accomplish this, the water rinse must be extremely effective at penetrating, flowing through, and removing wafer surface slurry from even the microscopic spaces between the cut wafers. Further, the rinse water must be provided with a large amount of mechanical energy, most preferably in a uni-directional mode in order to "sweep" away the abrasive slurry before said solids precipitation can occur.

With a large amount of mechanical force applied to the water rinse flow, the presence of even low-foaming surface active agents will create sufficient "foaming" that will quickly and effectively inhibit rinsing speed and efficiency, particularly on free space constricted surfaces such as the sliced "kerf slots" between wafers on a cut ingot from a wire saw slicing process. This will result in a lower yield of clean, properly rinsed wafers from the slurry cut, and is highly undesirable. The preferred water rinse composition effectively has no tolerance for foaming at all, and all such propensity under high mechanical force/agitation must be eliminated to produce an effective water rinse composition.

The art contains a large number of effective "defoamers" that might be used. Among these are those materials or compounds in which foaming is not eliminated, or for which very large levels of the defoamer are required to completely eliminate foaming. Further, many defoamers also interfere with the surface tension lowering properties of the added surfactant system, or may reduce the wetting or penetration properties of the treated water system, thereby reducing the effectiveness of the surfactant composition in the rinse water.

Also, since the treated rinse water is typically discarded to drain, it is important that the environmental properties of the additive surfactant composition be human and environmentally friendly, with very low or non-existent toxicity. This requirement further limits the available materials to be selected that will also perform to the effectiveness level described herein.

It is desirable that the aqueous rinse composition have the following characteristics:

1. Lower the surface tension of water as a method of increasing water penetration and wetting on a solid surface.
2. Independent of surface tension, increase the wetting of water on a solid surface.
3. Perform (1) and (2) above without causing or initiating any foaming of the cutting liquid. Absence of foaming should be complete, even in the presence of violent agitation of the water mixture.
4. Create a composition that is human and environmentally friendly providing a water solution/mixture that is of very low toxicity or non-toxic.
5. Create a composition whose surface tension and surface wetting/penetration properties in mixture with water are not substantially affected by the presence of solid particle contamination.

U.S. Pat. No. 6,383,991 to Hashimoto, et al, discloses an aqueous cutting oil composition which contains a polyether compound and one or more surfactants, preferably a non-ionic surfactant. The cleaning process involves the use of water at an elevated temperature and then using the immersion method, ultrasonic cleaning, vibration and/or spraying to clean the wafers.

U.S. Pat. No. 6,221,814 to Kaburagi et al discloses an aqueous cutting liquid which comprises a hydrophilic alcohol such as ethylene glycol and a lipophilic compound such as propylene glycol which uses an organic solvent or water in the cleaning process.

SUMMARY OF THE INVENTION

The present invention relates to a wafer/cut ingot cleaning composition and method for a wire saw cutting of hard material using abrasive gains. More particularly, there is provided a composition comprising an aqueous solution of an alkoxylated alcohol alone or in combination with a polyalkyl siloxane defoaming agent. The defoaming agent is utilized when a dynamic flow is utilized in the rinsing procedure and creates foam. The alkoxylated alcohol is used in an amount of dilution of about 30-100 parts of water to about 1 part wt/wt of the alkoxylated alcohol, preferably 60/1 wt/wt. The defoamer is used in an amount of about the same as the alkoxylated alcohol.

It is essential that the alkoxylated alcohol have good spreading and wetting characteristics. A surface tension of about 27.0 Dynes/cm at a water concentration of about 0.10-0.15 wt % and spreading/wetting characteristics on a silicon wafer of a 4 drop volume of about 3.8 cm in diameter after 120 seconds is advantageous.

The cleaning of the ingots and wafers is usually done in a vessel which, in the first step, rinses the sliced ingots with water and then rinsing the sliced ingots in a vessel containing the rinsing composition of the invention. This is followed by a final clean water rinse free or absent of any additives. There can be a number of different methods using the rinse composition with a dynamic flow of water such as fast unidirectional water flow, spraying, sonic, etc.

It is an object of the invention to provide a composition for rinsing sliced ingots and wafers from a wire saw operation.

It is a further object of the invention to rinse and clean wafers so as to be free of residues.

DESCRIPTION OF THE PREFERRED EMBODIMENTS

According to the present invention there is provided a composition and method for cleaning wafers from cut ingots from a wire saw process with abrasive grains. The ingots which are cut include ingots of silicon single crystals or polycrystals, GaAs, $SiO_2$, Sapphire, other optics or opto-electronic substrates, semiconductor substrates, other ceramic substrates, and the like.

The cutting operation takes place in a vessel containing an aqueous fluid such as water, a water/organic solvent such as a glycol, and the like.

The ingot is mounted on a frame that has the same curvature as the ingot itself. This is called the mounting beam. The ingot is attached to the mounting beam via temperature sensitive epoxy glue. The mounted ingot is mechanically attached to the moving saw table which then moves vertically at an appropriate speed through the moving wire during the cut. Once the cut is finished, the fully sliced ingot, still in place and adhered to the mounting beam by the epoxy glue, is backed out through the wire web, and removed from the saw.

The slurry covered/impregnated ingot, which is attached to the mounting beam is demounted from the saw table.

Once demounted, the fully sliced ingot and mounting beam are usually placed in a water cleaning station, which may consist of:

a) Recirculated water spray from all directions
b) Water bath with weir overflow and fast uni-directional water rinsing from a reservoir; or from a continuous water supply that is not recirculated.
c) Pre-rinse station which is designed to remove most of the dirty slurry from the ingot, followed by a "main" water rinse of (a) or (b) above, and then finally a clean, additive free "finishing rinse" of only water.

The pre-rinse station may be composed of water or polyalkylene glycol, such as polyethylene glycol, or a combination thereof which is recirculated to remove the bulk of the dirty slurry, that is coating the cut ingot. The waste water contains abrasive grains and cutting dust.

During the pre-rinse and main rinse, the alkoxylated alcohol is added to the water source to aid in speedy removal of slurry from the sliced wafer surfaces (i.e.; the wafers are separated and defined by the 100-200 μm "kerf" slots created by each wire during the ingot cut). Of greatest importance and immediacy is the removal of slurry from within the kerf slots separating each wafer in the ingot. If dynamic flow creates foaming, a defoaming agent is required. Any appropriate defoaming agent that meets the above mentioned requirements may be employed, though a polyalkyl siloxane defoamer is advantageously utilized. The alkoxylated alcohol is used in an amount of 30-100 parts of water to about 1 part wt/wt of alkoxylated alcohol. A similar amount of the defoamer is used when required.

Following the rinse, a final clean water rinse (finishing rinse) is needed to remove residues to avoid a residual film from potentially settling on the wafer surface. For the final rinse, only clean water without any additives is utilized.

Once the cut ingot has been completely water rinsed, it then goes to a clean, hot water bath from which the wafers are physically removed from the epoxy adhesive that binds the sliced ingot wafers to the mounting beam. This epoxy not only keeps the wafers in tight, immovable place during the cut, but also holds them tightly to the mounting beam during the water rinse, so that no wafers break loose, are chipped or otherwise crack apart, which can damage other wafers in the ingot.

The fully rinsed and clean wafers (i.e.; still attached to the mounting beam) are usually placed in a bath of warm to hot water (i.e.; 50-80° C.) in order to soften the epoxy for wafer separation and "cassetting".

The wafers are then separated individually and placed in wafer boats/cassettes (i.e.; cassetting).

The wafer boats are place in another bath of ambient to warm water to prevent drying and precipitation of water residues from the typical tap water employed.

Finally, for the solar cell process as an example, the wafers go through a hot surface etching process comprised often of NaOH or KOH solution at about 80-100° C. to perform a final surface clean and "planarization" prior to continuing on through the remaining process.

Low surface tension and excellent wetting ability allows the water solution to penetrate the areas in between the wafers more effectively than plain water. This would allow the wafers to be separated more easily since more of the slurry would be removed from the areas between the wafers and the wafers are less likely to adhere to each other and break during the separation process.

When an immersion water rinsing process is used, a defoamer is not required.

The preferred alkoxylated alcohol is commercially available under the trade name "Tego Wet" sold by Evonik Goldschmidt GmbH, Goldschmidtstrasse 100, 45127 Essen, Germany. The preferred defoamer is "SAG-2001" sold by Momentive Performance Materials, 3500 South State Rote 2, Friendly, W. Va. 26148.

Tergo Wet comprises oxirane, methyl polymer with oxirane, mono (3,5,5-trimethyl-hexyl)ether, CAS-No. 204336 having a neutral pH.

EXAMPLE1

General Procedure

Measurement of Spreading/Wetting Characteristics

1. To stirring D.I. water is added enough of Tego Wet 510 to create a reduced surface tension of the host water as measured by a Pt-ring tensiometer at 25° C. The resulting water mixture is mixed until a homogeneous solution is obtained.
2. A 4 drop volume of the solution is put onto a washed dried flat silicon wafer. The diameter of the drop is then measured in cm at specific time intervals of 0 sec., 60 sec and 120 sec. The increase in drop diameter over the time period is a measure of the spreading/wetting characteristics of the water solution.

Measured Surface Tension

| | Surfactant | Water Conc. (wt %) | Surface Tension (Dynes/cm) |
|---|---|---|---|
| 1. | Tegopren | 0.30 | 39.1 |
| 2. | Zonyl FSN | 0.10 | 27.6 |
| 3. | Calfax | 0.10 | 39.6 |
| 4. | Liposurf EST | 0.20 | 48.6 |
| 5. | Zonyl FSO | 0.10 | 20.4 |
| 6. | Palmolive | 0.50 | 22.1 |
| 7. | Tego Wet | 0.10 | 27.0 |

-continued

| | Measured Surface Tension | | |
|---|---|---|---|
| | Surfactant | Water Conc. (wt %) | Surface Tension (Dynes/cm) |
| 8. | Dawn Detergent | 0.25 | 26.4 |
| 9. | Joy Detergent | 1.0 | 27.0 |
| 10. | Daxad | 0.21 | 47.7 |
| 11. | SAG 2001 | 0.25 | 41.8 |

EXAMPLE2

Measured Wetting/Spreading Properties 4 drops of each surfactant compound, diluted as specified in D.I. water, were put onto a flat "as-cut" silicon wafer. The diameter of the drop volume is measured at the indicated time increments as a measure of the wetting properties.

| | | | | 4-drop Vol. Diameter (cm) | | |
|---|---|---|---|---|---|---|
| | Sample | Type | Water Conc. (wt %) | 0 sec. | 60 sec. | 120 sec. |
| 1. | D.I. Water | — | — | 1.0 | 1.0 | 1.0 |
| 2. | Joy Det. | Anionic/nonionic | 1.0 | 1.0 | 1.5 | 1.8 |
| 3. | Tego Wet | Alkoxylated Alcohol | 0.15 | 1.0 | 2.2 | 3.8 |
| 4. | Zonyl FSO | Telomer B Monoether With PEG | 0.15 | 1.0 | 1.7 | 2.5 |
| 5. | Dawn Det. | Anionic/nonionic | 1.0 | 1.0 | 1.7 | 2.2 |
| 6. | Liposurf EST | Na-trideceth sulfate | 0.20 | 1.0 | 1.3 | 1.5 |
| 7. | SAG 2001 | Polyalkyl siloxane | 0.25 | 1.0 | 1.2 | 1.4 |

CONCLUSIONS

1. The "TEGO WET 510" with or without SAG demonstrated the best wetting and spreading characteristics of all the surfactants tested.

2. The TEGO WET 510 gave the best wetting characteristics, even though the TEGO WET 510 concentration was lower than most other surfactants tested.

3. The TEGO WET 510 does not show the lowest surface tension results, demonstrating that wetting characteristics are not necessarily directly related to surface tension values and that the best choice for a surfactant system with superior wetting/spreading characteristics on solid surfaces cannot be determined solely from surface tension measurements.

4. SAG 2001, which is a defoamer by function, shows poor wetting characteristics under the conditions of the above tests.

5. Contrary to logical selection, a combination of TEGO WET 510 and SAG 2001 into a formulation demonstrates superior wetting/spreading characteristics despite the poor performance and predicted interference by SAG 2001.

6. As the tables show, even a TEGO WET/SAG formulation at a proportion 1/1.67 still produces superior wetting and spreading characteristics.

7. This data does not preclude the use of other defoam surfactants exclusive of SAG. However, the data does imply that even a defoamer with poor wetting and spreading characteristics will not interfere with the superior performance of the TEGO WET surfactant.

8. A number of TEGO WET surfactants were tested, all being alkoxylated alcohols. All performed similarly with respect to both surface tension results and wetting. It is this class of compounds that is the preferred choice for the best performing formulation system.

9. All tested surfactants foam to a greater or lesser degree. Performance of the chosen formulated system must occur with no foaming. Foam causes significant interruption in the efficient penetration and contact of the rinse water with the slurry to be removed from the solid wafer surface. It is a requirement of the invention that there be no foaming of any kind during the use and performance of the formulation. The combination of TEGO WET with SAG as the preferred formulation meets this requirement, and demonstrates superior performance to those surfactants that contain no defoam capability.

What is claimed is:

1. In a wire saw process for cutting ingots to produce wafers, the improvement which comprises in the rinsing of the cut wafers and ingot, providing a water bath containing:

a) an aqueous solution containing from about 30 to 100 parts by weight of water;

b) about 1 part by weight of an alkoxylated alcohol; and c) about 1 part by weight of a polyalkyl siloxane, wherein said alkoxylated alcohol comprises oxirane methyl polymer with oxirane, mono (3,4,5-trimethylhexyl) ether.

2. The process of claim 1 wherein said alkoxylated alcohol provides a surface tension of about 27.0 Dynes/cm at a water concentration of about 0.10 to 0.15 wt %.

3. The process of claim 2 wherein said alkoxylated alcohol has a spreading/wetting characteristic on a silicon wafer of a 4-drop volume of about 3.8 cm in diameter after 120 seconds.

4. The process of claim 1 wherein the water bath has a dynamic flow of water.

5. The process of claim 1 wherein the ingot and wafers are pre-rinsed with water.

6. The process of claim 1 wherein the ingot and wafers are subsequently rinsed with water.

7. The process of claim 1 wherein the ingot and wafers are rinsed by spraying.

8. The process of claim 1 wherein the bath is free of foam.

9. The process of claim 1 wherein said ingot comprises silicon.

10. The process of claim 1 wherein the water bath further comprises an organic solvent.

11. The process of claim 10 wherein the organic solvent is a glycol.

* * * * *